United States Patent [19]

Reale

[11] Patent Number: 4,585,322

[45] **Date of Patent: * Apr. 29, 1986**

[54] CORONA GENERATING DEVICE

[75] Inventor: Louis Reale, Rochester, N.Y.

[73] Assignee: Xerox Corporation, Stamford, Conn.

[ * ] Notice: The portion of the term of this patent subsequent to Apr. 29, 2003 has been disclaimed.

[21] Appl. No.: 703,971

[22] Filed: Feb. 21, 1985

Related U.S. Application Data

[63] Continuation-in-part of Ser. No. 680,879, Dec. 12, 1984.

[51] Int. Cl.[4] ..... G03G 15/00

[52] U.S. Cl. ..... 355/3 CH; 250/325; 250/326; 430/902; 361/212

[58] Field of Search ..... 355/3 CH, 14 CH; 430/902; 55/74, 387; 361/212; 250/324, 325, 326

[56] References Cited

U.S. PATENT DOCUMENTS

| | | | |
|---|---|---|---|
| 2,574,225 | 11/1951 | Ringle et al. | 204/38 |
| 2,813,804 | 11/1957 | Kendall et al. | 117/130 |
| 2,836,725 | 5/1958 | Vyverberg | 250/49.5 |
| 3,392,039 | 7/1968 | Cuneo, Jr. | 106/84 |
| 3,862,420 | 1/1975 | Banks et al. | 250/324 |
| 4,086,650 | 4/1978 | Davis et al. | 361/229 |
| 4,265,990 | 5/1981 | Stolka et al. | 430/59 |
| 4,318,610 | 3/1982 | Grace | 355/14 D |

OTHER PUBLICATIONS

"Electroless Plating Today", *Metal Finishing*, pp. 45–49 and 52, Edward B. Saubestre, Aug. 1962.

Research Disclosure—Nov. 1980, p. 508, Item 19957, "Corona Discharge Unit".

Defensive Publication T94.0022—Pressurized and Filtered Xerographic System—Rodda—pub. Nov. 4, 1975.

*Primary Examiner*—Arthur T. Grimley
*Assistant Examiner*—David S. Warren
*Attorney, Agent, or Firm*—Samuel E. Mott, III

[57] ABSTRACT

A corona generating device for depositing negative charge on an imaging surface carried on conductive substrate comprises at least one elongated conductive corona discharge electrode, means to connect the electrode to a corona generating potential source, at least one element adjacent the corona discharge electrode capable of adsorbing nitrogen oxide species generated once the corona generating electrode is energized and capable of desorbing nitrogen oxide species once that electrode is not energized, the element being coated with a substantially continuous thin dehydrated alkaline film of an alkali silicate to neutralize the nitrogen oxide species when generated. In a preferred embodiment the corona discharge electrode comprises a thin wire coated at least in a discharge area with a dielectric material and at least one element comprises a conductive shield and an insulating housing having two sides adjacent the shield to define the longitudinal opening to permit ions emitted from the electrode to be directed toward a surface to be charged, both the shield and the two sides of the housing being coated with a substantially continuous thin dehydrated alkaline film of an alkali silicate.

16 Claims, 3 Drawing Figures

CORONA GENERATING DEVICE

This application is a continuation-in-part of copending U.S. application Ser. No. 680,879 filed on Dec. 12, 1984, and entitled Corona Generating Device.

REFERENCE TO RELATED APPLICATIONS

Reference is hereby made to copending applications U.S. Ser. No. 680,867, entitled Corona Generating Device, in the name of Joan R. Ewing et al., filed Dec. 12, 1984; and to U.S. Ser. No. 680,861, entitled Corona Generating Device, in the name of Robert P. Altavela et al., filed Dec. 12, 1984.

BACKGROUND OF THE INVENTION

The present invention relates generally to charging devices and in particular to charging devices which produce a negative corona.

In an electrostatographic reproducing apparatus commonly used today, a photoconductive insulating member may be charged to a negative potential, thereafter exposed to a light image of an original document to be reproduced. The exposure discharges the photoonductive insulating surface in exposed or background areas and creates an electrostatic latent image on the member which corresponds to the image areas contained within the original document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

Various types of charging devices have been used to charge or precharge photoconductive layers. In commercial use, for example are various types of corona generating devices to which a high voltage of 5,000 to 8,000 volts may be applied to the corotron device thereby producing a corona spray which imparts electrostatic charge to the surface of the photoreceptor. A recently developed corona charging device is described in U.S. Pat. No. 4,086,650 to Davis et al., commonly referred to in the art as a dicorotron wherein the corona discharge electrode is coated with a relatively thick dielectric material such as glass so as to substantially prevent the flow of conduction current therethrough. The delivery of charge to the photoconductive surface is accomplished by means of a displacement current or capacitive coupling through the dielectric material. The flow of charge to the surface to be charged is regulated by means of a DC bias applied to the corona shield. In operation an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In the dicorotron device described above the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor it often is desired to provide a negative precharge to another type photoreceptor such as a selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically in such a precharge corotron a AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

It has been found that when using corona discharge devices that produce a negative corona, certain difficulties may be observed. It is believed that various nitrogen oxide species are produced by the corona and that these nitrogen oxide species are adsorbed by solid surfaces. In particular it is believed that these oxide species are adsorbed by the conductive shield as well as the housing of the corona generating device. The shield may in principle be made from any conductor but is typically made from aluminum and the housing may be made from any of a number of structural plastics such as a glass filled polycarbonate. This adsorption of nitrogen oxide species occurs despite the fact that during operation the corona generating device may be provided with a directed air flow to remove the nitrogen oxide species as well as to remove ozone. In fact during the process of collecting ozone the air flow may direct the nitrogen oxide species to an affected area of the charging device or even some other machine part. It has also been found that after such exposure when a machine is turned off for extended periods of idleness that the adsorbed nitrogen oxide species gradually are desorbed, that is the adsorption is a physically reversible process. Then, when the operation of the machine is resumed, a copy quality defect is observed in the copies produced in that a line image deletion or lower density image is formed across the width of the photoreceptor at that portion of its surface which was at rest opposite the corona genersting device during the period of idleness. While the mechanism of the interaction of the desorbed nitrogen oxide species and the photoreceptor layers is not fully understood, it is believed that they in some way interact with the surface of the photoreceptor increasing the lateral conductivity so that it cannot retain a charge in image fashion to be subsequently developed with toner. This basically causes narrow line images to blur or to wash out and not be developed as a toner image. This defect has been observed with conventional selenium photoreceptors which generally comprise a conductie drum substrate having a thin layer of selenium or alloy thereof vacuum deposited on its surface as the imaging surface. The difficulty is also perceived in photoreceptor configuration of plates, flexible belts, and the like, which may include one or more photoconductive layers in the supporting substrate. The supporting substrate may be conductive or may be coated with a conductive layer over which photoconductive layers may be coated. Alernatively, the multilayered electroconductive imaging photoreceptor may comprise at least two electrically operative layers, a photogenerating layer or a charge generating layer and a charge transport layer which are typically applied to the conductive layer. For further details of such a layer attention is direction to U.S. Pat. No. 4,265,990. In all these varying structures several of the layers be applied with a vacuum deposition technique for very thin layers.

Furthermore with prolonged exposure of the photoreceptor to the desorbing nitrogen oxide species during extended periods of idleness the severity of the line defect or line spreading increases. While the mechanism is not fully understood it has been observed that even after a relatively short period of time, 15 minutes, and a period of idleness of, say, several hours, a mild line defect and concurrent image deletion may be perceived. During the initial stage of exposure of the photoreceptor to the desorbing nitrogen oxide species, it is possible to rejuvenate the photoreceptor by washing with alcohol since reaction between the photoreceptor and the nitrogen oxide species is purely at the surface. However after a prolonged period of time the reaction tends to penetrate the photoreceptor layer and cannot be washed off with the solvent. Thus, for example, the problem is perceived after a machine has been operated for about 10,000 copies, rested overnight and when the operator activates the machine the following morning, the line deletion defect will appear. As indicated above the defect is reversible to some degree by a rest period. However, the period involved may be of the order of several days which to an operator is objectionable.

Similar difficulties are encountered in a precharge corotron with a negative DC potential applied. Attempts to solve that problem by nickel plating the corotron shield met with limited success in that nickel combined with the nitrogen oxide species forming a nickel nitrate which is a deliquescent salt and on continued use becomes moist with water from the air eventually accumulating sufficient water that droplets may form and drop off onto the photoreceptor. Furthermore the nickel nitrate salts are green crystalline and loosely bonded rather than a cohesive durable film. In another attempt to solve a similar difficulty in a negative charging AC dicorotron device the shield is coated first with a layer of nickel that is subsequently plated with gold. However as a result of the extreme expense of gold, the gold is plated in a very thin layer and consequently the layer is discontinuous having numerous pores in the layer. Gold plating is theorized to provide a relatively inert surface which will not adsorb the nitrogen oxide species. However with the thin porous layer of gold, the nickel substrate underneath the gold corrodes forming nickel nitrates in the same manner as with the precharge corotron and experiences similar difficulties redulting in limited useful life.

PRIOR ART

Item No. 19957 in the Research Disclosure Journal of November 1980 at page 508 describes an electrophotographic copying machine having corona charging unit wherein the ions generated from the corona dishcarge can interact with the photoconductive member and the conductive housing to form salts, e.g. nitrates which during an overnight period of rest may have a detrimental effect on the part of the stationary photoconductive member opposite the opening to the corona charging unit. This detrimental effect is claimed to be overcome by coating the inner side of the housing with a cellulose acetate butyrate copolymer in which carbon black particles have been dispersed.

SUMMARY OF THE INVENTION

In accordance with the present invention a corona generating device for depositing a negative charge on an imaging surface is provided wherein the damaging nitrogen oxide species generated by the corona charging unit and adsorbed by at least one element of the corona charging device adjacent the corona discharge electrode during operation and desorbed when at rest, are neutralized.

In accordance with the principle aspect of the present invention the element which adsorbs and desorbs the nitrogen oxide species is coated with a substantially continuous thin dehydrated alkaline film of an alkali metal silicate to neturalize the nitrogen oxide species when they are generated.

In a further aspect of the present invention, the element which absorbs and desorbs the nitrogen oxide species comprises a conductive shield which substantially surrounds the corona discharge electrode and has a longitudinal opening therein to permit ions emitted from the electrode to be directed toward the surface to be charged.

In a further aspect of the present invention, the corona discharge electrode comprises a thin wire coated at least in the discharge area with a dielectric material.

In a further aspect of the present invention, the corona generating device comprises a planar shield and includes an insulating housing having two sides adjacent such shield to define a longitudinal opening to permit ions emitted from the electrode to be directed toward the surface to be charged. The two sides of the insulating housing as well as a conductive shield are coated with a substantially continuous thin dehydrated alkaline film of an alkali metal silicate.

In a further aspect of the present invention, a power supply means is supplied for applying an AC corona generating voltage to the corona discharge electrode and for providing a DC potential between the substrate to be charged and the conductive shield.

In a further aspect of the present invention, the alkali metal silicate coatings are at least about 5 microns in thickness.

In a further aspect of the present invention, the dehydrated alkaline film is a dehydrated product of an aqueous sodium silicate solution having a silica to oxide weight ratio from about 1.6 to about 3.75.

In another aspect of the present invention, the dehydrated alkaline film is a dehydrated product of an aqueous potassium silicate solution having a silica oxide weight ratio of from about 2.1 to 2.5.

For a better understanding of the invention as well as other aspects and further features thereof, reference is had to the following drawings and descriptions.

DESCRIPTION OF THE PREFERRED EMBODIMENTS

Figure 1:
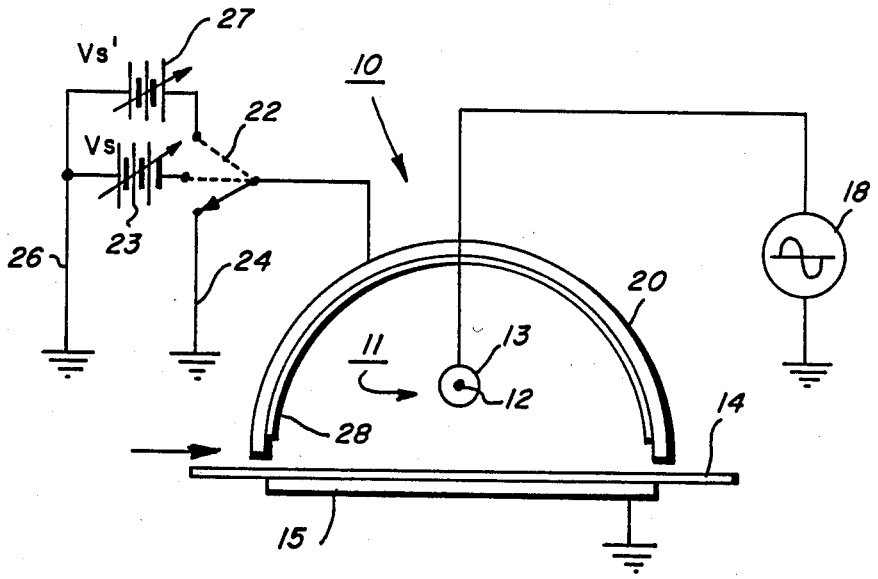
FIG. 1 is an illustrative cross section of a corona discharge device according to the present invention.

Referring to FIG. 1 the corona generator 10 of this invention is seen to comprise a corona discharge electrode 11 in the form of a conductive wire 12 having a relatively thick coating 13 of dielectric material.

A charge collecting surface 14 is shown which may be a photoconductive surface in a conventional xerographic systems. The charge collecting surface 14 is carried on a conductive substrate 15 held at a reference potential, usually machine ground. An AC voltage source 18 is connected between the substrate 15 and the corona wire 12, the magnitude of the AC source being selected to generate a corona discharge adjacent the wire 12. A conductive shield 20 is located adjacent the corona wire on the side of the wire opposite the chargeable surface.

The shield 20 has coupled thereto a switch 22 which depending on its position, permits the corona device to be operated in either a charge neutralizing mode or a charge deposition mode. With the switch 22 as shown, the shield 20 of the corona device is coupled to ground via a lead 24. In this position, no DC field is generated between the surface 14 and the shield 15 and the corona device operates to neutralize over a number of AC cycles any charge present on the surface 14.

With switch 22 in either of the positions shown by dotted lines, the shield is coupled to one terminal of a DC source 23 or 27, the other terminals of the sources being coupled by lead 26 to ground thereby establish a DC field between the surface 14 and the shield 20. In this position, the corona operates to deposit a net charge onto the surface 14, the polarity and magnitude of this charge depends on the polarity and magnitude of the DC bias applied to the shield 20.

The corona wire 13 may be supported in conventional fashion at the ends thereof by insulating end blocks (not shown) mounted within the ends of shield structure 20. The wire 12 may be made of any conventional conductive filament material such as stainless steel, gold, aluminum, copper, tungsten, platinum or the like. The diameter of the wire 11 is not critical and may vary typically between 0.5–15 mil. and preferably is about 9 mils.

Any suitable dielectric material may be employed as the coating 13 which will not break down under the applied corona AC voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona enviroment.

The thickness of the dielectric coating 13 used in the corona device of the invention is such that substantially no conduction current or DC charging current is permitted therethrough. Typically, the thickness is such that the combined wire and dielectric thickness falls in the range from 7–30 mil with typical dielectric thickness of 2–10 mil. Glasses with dielectric breakdown strengths above 2 KV/mil at 4 KHz and in the range of 2 to 5 mil thickness have been found by experiment to perform satisfactorily as the dielectric coating material. As the frequency or thickness go down the strength in volts will usually increase. The glass coating selected should be free of voids and inclusions and make good contact with or wet the wire on which it is deposited. Other possible coatings are ceramic materials such as Alumina, Zirconia, Boron Nitride, Beryllium Oxide and Silicon Nitride. Organic dielectrics which are sufficiently stable in corona may also be used.

The frequency of the AC source 18 may be varied widely in the range from 60 Hz. commercial source to several megahertz. The device has been operated and tested at 4 KHz. and found to operate satisfactorily.

The shield 20 is shown as being semi-circular in shape but any of the conventional shapes used for corona shields in xerographic charging may be employed. In fact, the function of the shield 20 may be performed by any conductive member, for example, a base wire, in the vicinity of the wire, the precise location not being critical in order to obtain satisfactory operation of the device.

With the switch 22 connected as shown so that the shield 20 is grounded, the device operates to inherently neutralize any charge present on the surface 14. This is a result of the fact that no net DC charging current passes through the electrode 11 by virtue of the thick dielectric coating 13 and the wire 12.

Referring to FIG. 1, operation of the corona device of the invention to deposit a specific net charge on an imaging surface is accomplished by moving switch 22 to one of the positions shown in dotted lines, whereby a DC potential of either positive or negative polarity with respect to the surface 15 may be applied to the shield.

In charging operation typical AC voltages applied to the corona electrodes are in the range from 4 KV to 7 KV at a frequency between 1 KHz and 10 KHz. With the conductive substrate of the imaging member being held at ground potential a negative DC bias of from about 800 volts to about 4 KV is applied to the shield. For further details of the manner of operation of the above described dicorotron device, attention is directed to U.S. Pat. No. 4,086,650 to Davis et al which is hereby incorporated in its entirety into the instant disclosure.

Referring once again to FIG. 1, the shield 20 is coated at least on its top with a substantially continuous thin dehydrated alkaline film 28 of an alkali metal silicate to neutralize the nitrogen oxide species that may be generated when a dicorotron is energized. The exact mechanism by which the alkali metal silicate neturalizes the nitrogen oxide species is not fully understood. However, it is believed that the cation of the alkali metal silicate film combines with the nitrogen oxide species to form alkali metal nitrates in an irreversible reaction and therefore completely remove the possiblity of exposure of the photoreceptor to the nitrogen oxide species. It is also believed that any silicate anions present combine with any hydronium ions present in the hydrated nitrogen oxide species to neutralize the hydronium ions. While the alkali metal nitrates that may be formed are not totally insoluble in water and therefore in high humidity environments become partly solubilized by water in the air, the severity of this mechanism is such as not to be a deterrent to the favorable action of prohibiting the deletion described above. In order to form this irreversible neutralization of the nitrogen oxides, the alkaline film should be sufficiently thick that it will not be consumed in a reasonable period of time thereby limiting the operation of the device. Accordingly it is preferred that the dehydrated alkaline film be at least 5 microns in thickness to provide an acceptable operational life. Typically films are deposited in a thickness up to about a mil or more to insure that no nitrogen oxides are absorbed and subsequently desorbed by the shield, the alkaline film should be substantially continuous without pores.

The dehydrated alkali metal silicate films may be formed on the shield by applying an aqueous alkali metal silicate solution as a thin film to the shield. Upon heating the liquid films dehydrate to provide a strong rigid inorganic adhesive bond to the substrate. Typically the films can be applied by spraying or brushing as with a paint so as to provide a coherent film on the shield. The sodium, potassium and lithium silicate films may be formed from any suitable commercially available aqueous solution of sodium, potassium, or lithium silicate. Typically, the aqueous solutions of sodium silicate are available having a silica to oxide weight ratio of from about 1.6 to about 3.75, density within the range of 35° Be' 59° Be' when measured at 20° C., a solids content from about 30 percent to about 55 percent by weight, and a viscosity of from about 200 to 800 centipoises. The aqueous potassium silicate solutions commercially available typically have a silica to oxide weight ratio of from about 2.1 to 2.5, a density of about 30° Be' to about 40° Be' when measured at 20° C., a solids content of from about 25 to 40 percent by weight and a viscosity of from about 7 to 1050 centipoises. A silica oxide ratio of 2.5 is preferred since it exhibits high water resistance. The aqueous lithium silicate solutions typically have a silica to oxide weight ratio of from about 4.6 to 5.9, density of from about 18° Be' to about 36° Be', a viscosity of about 180 centipoises and a solids content of about 22 percent by weight. In those applications wherein the conductive coating is desired such as the continuous thin layer on shield 20 as illustrated in FIG. 1, it is preferable to add a conductive filler or pigment to the sodium or potassium silicate solution. Any suitable particulate conductive filler or pigment may be employed. Typical materials include conductive carbon such as graphite. In addition, if desired, water resistance may be increased by adding heavy metal oxides, carbonate insolubilizing agents, organic polymers or fillers such as mica.

Figure 2:
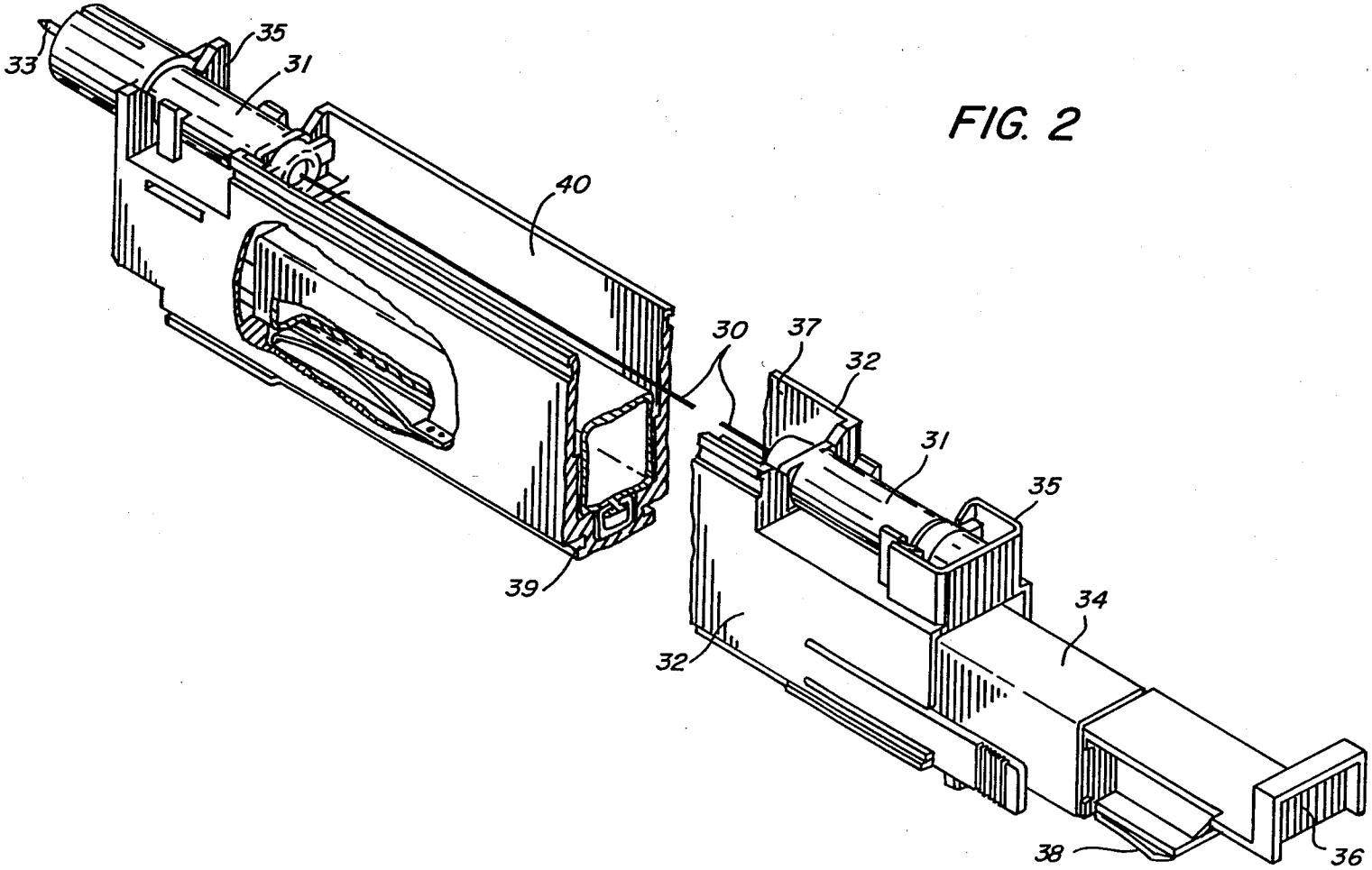
FIG. 2 is an isometric view of a preferred embodiment of a dicorotron according to the present invention.

FIG. 2 illustrates a preferred embodiment in the dicorotron device according to the present invention. In FIG. 2 the dicorotron wire 30 is supported between anchors 31 at opposite ends which are anchored in end blocks 35. The conductive shield 34 is constructed in tubualr fashion in such a way as to be slideably mounted in the bottom of the housing 39 by means of handle 36. The shield is connected to the power supply through a sliding contact on its inner surface to a leaf spring which in turn is connected to a DC pin connector (not shown). The power potential may be positive, negative, or zero (grounded) depending on device function. It is fastened in place when inserted within the housing 39 by means of spring retaining member 38. When inserted in the machine high voltage contact pin 33 provides the necessary contact to the AC power supply. In addition to the conductive shield 34 the housing 39 comprises two vertically extending side panels 32 extending the entire length of the dicorotron wire. Both the top and inner surfaces of the shield 34 have a substantially continuous thin dehydrated alkaline film of the alkali metal silicate. In addition, the vertically extending panels 32 of the housing 39 are also coated with a substantially continuous thin dehydrated alkaline film 40 of alkali metal silicate. The housing 39 together with the side planels 32 may be made from a single one piece molding from any suitable material such as a glass filled polycarbonate. If desired the glass filled polycarbonate side panels may be primed with a suitable plastic primer to improve the adhesion between the alkaline metal silicate coating which is hydrophillic and the polycarbonate which is hydrophobic. Preferably such a primer will contain large amounts of silica or silicates such as Krylon all purpose charcoal black 1316 available from Borden, Inc., Columbus, Ohio.

A comparative test was conducted with the device illustrated in FIG. 2. In the first sample a dicorotron device without the alkali metal silicate coatings and just employing the conductive shield made out of aluminum together with the single one piece molded housing from a glass filled polycarbonate material were used in the Xerox 1075 as a charging device for the production of about 10,000 copies. Thereafter the machine was shut down and rested overnight and operation resumed the next morning at which time a line deletion or drop in line density was observed across that narrow portion of the photoreceptor which was opposite the dicorotron charging device during shut down. This was a result of lower surface charge density and a corresponding lower developed toner result of a mass per unit area. This image deletion was repeated for each revolution of the photoreceptor.

To test the efficiency of the alkaline alkali metal silicate coatings according to the present invention, a strip of aluminum, half of which is coated with a sodium silicate and half of which was not coated with the sodium silicate was placed over the elongated slot of the dicorotron charging device which was activated for about 1000 hours. Thereafter the aluminum strip was removed and placed adjacent to the same photoreceptor belt spaced apart by about 0.06 inches for one hour. The photoreceptor was then charged and exposed to an image pattern with no deletion problem being experienced over that portion of the photoreceptor placed adjacent to the portion of the aluminum strip which had been coated with the sodium silicate solution. However, the portion of the photoreceptor opposite the uncoated portion of the aluminum strip showed signs of the deletion problem in that the line images were blurred in that area. The sodium silicate solution used in this test was Electrodag 181 available from Acheson Colloid Company, Port Huron, Mich. which is an aqueous dispersion of semicolloidal graphite in a sodium silicate binder which cures in one hour at 400° C. to form a hard layer on the desired surface. It has a silica oxide ratio of 2.0, a density of 11 pounds/gal, a solid content of 36.0% by weight, including graphite, and a viscosity of 180 centipoises. This was applied to the aluminum strip by first cleaning it to free it of contaminates such as oil or chemical deposits and drying. Thereafter the sodium silicate solution was applied by brushing and dried at 100° C. for about one hour to remove excess water. In addition to the alkali metal silicate solutions being applied by brushing, the coating may also be effected by conventional spraying or dipping techniques.

Figure 3:
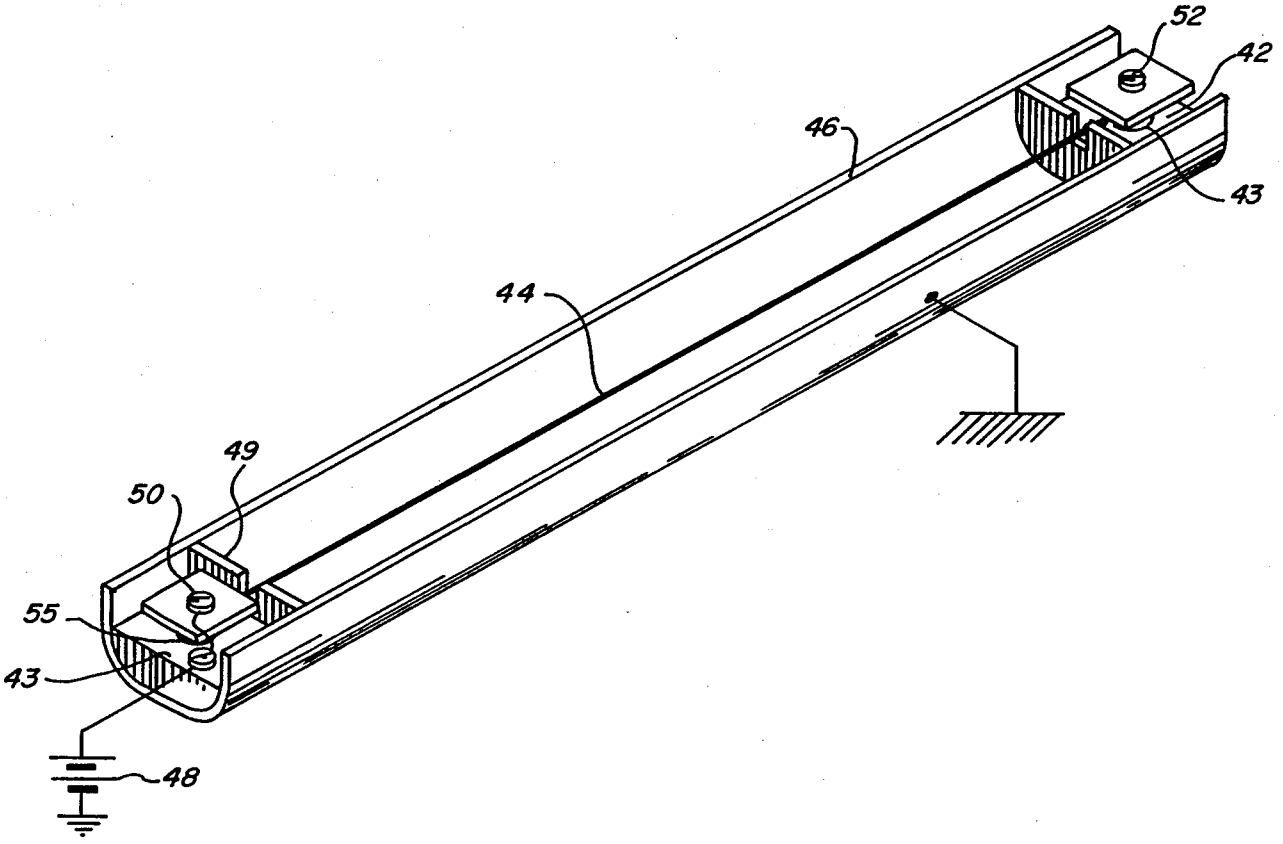
FIG. 3 is an isometric view of another preferred embodiment of corotron according to the present invention.

FIG. 3 illustrates an alternative embodiment according to the present invention and in particular is directed to a single wire corotron device wherein the wire 44 is supported between insulating end block assemblies 42 and 43. A conductive corotron shield 46 which is grounded increases the ion density available for conduction. Since no charge builds up on the shield the voltage between the shield and the wire remain constant and a constant density of ions is generated by the wire. The effect of the grounded shield is to increase the amount of current flowing to the plate. The corona wire 44 at one end is fastened to port 52 in the end block assembly and at the other end is fastened to port 50 of the second end block assembly. The wire 44 at the second end of the corona generating device is connected to the corona potential generating source 48 by lead 55. Such a device might have utility as an AC precharge corona generating device in which case the corotron shield 46 is coated with a thin dehydrated alkaline film of an alkali metal silicate.

The dicorotron charging device and in particular that illustrated in FIG. 2 above may have application, for example, as the charging device in the machine concept described and illustrated in U.S. Pat. No. 4,318,610 to Grace.

As pointed out above, the negative charging devices according to the present invention have the advantage of successfully neutralizing nitrogen oxides formed during the charging operation. While it is not fully understood it is believed that the cations of the alkali metal silicate combined with the nitrogen oxide species in an irreversible reaction forming alkali metal nitrates. The sodium and potassium silicates, according to the present invention, have the distinct advantage of being readily commercially available in an aqueous solution and may be readily applied to necessary surfaces by simple brushing, spraying and dipping techniques without the use of extensive and expensive equipment. Furthermore it provides comparatively durable, corrosion resistant, water resistant, hard protective and reactive coatings on the surfaces to which they are applied. If necessary, they can be made conductive by the addition of conductive filler or pigment such as graphite. This is in contrast to protective films made from such materials as sodium borate, sodium carbonate, sodium phosphate, sodium hydroxide and even sodium metasilicate (silica oxide ratio of 1 to 1) which applied from aqueous solution do not form films but rather crystalize and further the crystals are relatively water soluble making use in an application where there is high humidity impractical. Further, since they do not form thin continuous films they are not durable.

All the patents and the article referred to herein are hereby incorporated by reference in their entirety into the instant specification.

While the invention has been described with reference to specific embodiments it will be apparent to those skilled in the art that many alternatives, modifications and variations may be made. For example, the grid in a conventional scorotron may be coated with an alkali metal silicate when the scorotron has a negative DC potential or AC potential applied. Accordingly, it is intended to embrace such modifications and alternatives as may fall within the spirit and scope of the appended claims.

What is claimed is:

1. A corona generating device for depositing a negative charge on an imaging surface carried on a conductive substrate held at a reference potential comprising;

at least one elongated conductive corona discharge electrode supported between insulating end blocks, means to connect said electrode to a corona generating potential source, at least one element adjacent said corona discharge electrode capable of adsorbing nitrogen oxide species generated when said corona discharge electrode is energized and capable of desorbing nitrogen oxide species when said electrode is not energized, said at least one element being coated with a substantially continuous thin dehydrated alkaline film of an alkali metal silicate to neutralize the nitrogen oxide species when generated.

2. The corona generating device of claim 1, wherein said dehydrated alkaline film is the dehydrated product of an aqueous sodium silicate solution having a silica to oxide weight ratio of from about 1.6 to about 3.75, density of form about 35° Be' to about 60° Be' at 20° C. and a viscosity of from about 200 to about 800 centipoises.

3. The corona generating device of claim 1, wherein said dehydrated alkaline film is the dehydrated product of an aqueous potassium silicate solution having a silica to oxide weight ratio from about 2.1 to 2.5, a density of from about 30° Be' to about 40° Be° at 20° C. and a viscosity of from about 7 to about 1050 centipoises.

4. The corona generating device of claim 3, wherein said silica oxide ratio is 2.5.

5. The corona generating device of claim 2, wherein said silica oxide ratio is 2.

6. The corona generating device of claim 1, wherein said silicate coating layer are at least about 5 microns in thickness.

7. The corona generating device of claim 1, wherein said at least one element comprises a conductive shield which substantially surrounds said corona discharge electrode and has a longitudinal opening therein to permit ions emitted from the electrode to be directed toward the surface to be charged.

8. The corona generating device of claim 1, wherein said corona discharge electrode comprises a thin wire coated at least in the dishcarge area with a dielectric material, and said conductive shield has means associated therewith to connect to a potential source.

9. The corona generating device of claim 7, wherein said shield is planar on one side of the corona discharge electrode and further including an insulating housing having two sides adjacent said shield to define a longitudinal opening to permit ions emitted from the electrode to be directed toward a surface to be charged, said two sides of said insulating housing being coated with a substantially continuous thin dehydrated alkaline film of an alkali metal silicate.

10. The corona generating device of claim 9, wherein said insulating housing includes two planar side elements which together with the shield enclose the corona discharge electrode on three sides.

11. The corona generating device of claim 8, wherein said dielectric material is glass.

12. The corona generating device of claim 10, further including power supply means for applying an A.C. corona generating voltage to said electrode and providing a D.C. potential between said substrate and said shield.

13. The corona generating device of claim 10, wherein said silicate coatings are at least 5 microns in thickness on said shield and said two sides of said insulating housing.

14. The corona generating device of claim 13, wherein said dielectric material has a thickness sufficient to prevent the flow of net D.C. current through said wire.

15. The corona generating device of claim 1, wherein said dehydrated alkaline film contains an amount of conductive particulate material to render the film conductive.

16. A corona generating device for depositing a negative charge on an imaging surface carried on a conductive substrate held at a reference potential comprising;

at least one elongated conductive corona discharge electrode supported between insulating end blocks, means to connect said electrode to a corona generating potential source, at least one element adjacent said corona discharge electrode capable of adsorbing nitrogen oxide species generated when said corona discharge electrode is energized and capable of desorbing nitrogen oxide species when said electrode is not energized, said at least one element being coated with a substantially continuous thin dehydrated alkaline film to neutralize the nitrogen oxide species when generated.

* * * * *